United States Patent [19]

Hunt

[11] Patent Number: 5,042,851

[45] Date of Patent: Aug. 27, 1991

[54] EXIT DEVICE HAVING ADJUSTABLE CONCEALED RODS

[75] Inventor: Larry R. Hunt, Lenoir City, Tenn.

[73] Assignee: Yale Security Inc., Monroe, N.C.

[21] Appl. No.: 559,713

[22] Filed: Jul. 30, 1990

[51] Int. Cl.[5] ..... E05C 1/12

[52] U.S. Cl. ..... 292/21; 292/36; 292/DIG. 60

[58] Field of Search ..... 70/92; 49/319; 292/21, 292/92, DIG. 60, 36

[56] References Cited

U.S. PATENT DOCUMENTS

| | | | |
|---|---|---|---|
| 1,721,489 | 7/1929 | Prinzler | 292/92 |
| 2,824,440 | 2/1958 | Jewett et al. | 292/92 |
| 2,887,336 | 5/1959 | Meyer | 292/21 |
| 3,149,864 | 9/1964 | Foster | 292/92 |
| 3,819,213 | 6/1974 | Vanderburgh | 70/92 |
| 3,940,886 | 3/1976 | Ellingson, Jr. | 49/319 |
| 4,005,886 | 2/1977 | Lirette | 292/92 |
| 4,598,939 | 7/1986 | Krupicka et al. | 292/92 |
| 4,601,499 | 7/1986 | Kim | 292/DIG. 60 |
| 4,796,931 | 1/1989 | Heid | 292/DIG. 60 |
| 4,881,765 | 11/1989 | Heid | 292/DIG. 60 |

*Primary Examiner*—Eric K. Nicholson
*Attorney, Agent, or Firm*—Dallett Hoopes

[57] ABSTRACT

Vertical concealed rods are attached to the respective ends of the slider of an exit device by adjustment bolts and bracket assemblies. Each bracket assembly is held adjacent the head of its adjustment bolt by a retainer. Once the cover of the latch mechanism is removed, the bolts are readily accessible from the outside of the door.

3 Claims, 2 Drawing Sheets

EXIT DEVICE HAVING ADJUSTABLE CONCEALED RODS

BACKGROUND OF THE INVENTION

1. Field of the Invention

This invention relates to an exit device—that is, a door latch operated by a horizontal panic bar or press plate—having concealed vertical latch operator rods which are adjustable in length. More particularly this invention relates to an exit device having concealed rods which are adjustable in length from outside the door structure.

2. Description of Related Art Including Information Disclosed Under §1.97 to 1.99

In the prior art in has been fairly common to provide an exit device with vertical rods which are concealed in the hollow shutting stile of the door. These rods, which are vertical, extend both up and down from the exit device to operate latch means which cooperate with respective receivers in the door lintel and threshold.

Because the latch mechanisms are assembled after the door is installed, the vertical rods often require lengthwise adjustment so that the latching will operate properly. This is true when the latches are initially installed in the door and also when the frame "works" (that is, changes dimension and shape slightly) as the building settles.

In the past, with the panic devices having vertical rods which are surface mounted on the inside face of the door, vertical adjustment of the rods has been easy: it has been merely necessary to wrench around the threaded end of the rod which fits into a threaded fitting in the latch-operating mechanism, to thereby change the length of the rod. By "length of the rod", of course, what is meant is the distance from the latch-operating mechanism to the remote end of the rod in a given position of the operation of the mechanism.

With the advent of conceal rods, the adjustment of the rods has been made somewhat more complicated because the rods are inaccessible from outside the door. Often the door would have to be taken off its hinges and the end of the rod turned to change length.

An early attempt to solve this problem with concealed rods is disclosed in U.S. Pat. No. 1,721,489 issued Jul. 16, 1929 to Prinzler. In this patent each rod fits into a boss in the latch mechanism and is held therein by a set screw which, when the latch face plate is removed, may be loosened so that the length of the rod may be adjusted. The set screw may then be reset.

Another attempt is disclosed in U.S. Pat. No. 2,887,336 which issued May 19, 1959 to Meyer. In this arrangement the rod terminates in a plate which has a sawtooth surface to mate with a sawtooth surface on the latch mechanism operator. A screw is provided to hold the sawtooth surface in engagement, the screw being loosened to readjust the sawtooth surfaces if necessary, and then tightened.

The U.S. Pat. No. 3,940,886 which issued Mar. 2, 1976 to Ellingson, Jr. has the rods attached to separate operating members which are connected by a threaded member, the threaded member being engageable by the panic bar.

The Kim U.S. Pat. No. 4,601, 499 which issued Jul. 22, 1986 attaches the rods to horizontal limbs held on the latch housing by threaded elements which are mounted in special boxes slideable against the housing as the push plate is depressed.

Finally, U.S. Pat. No. 4,881,765 to Heid which issued Nov. 21, 1989, permits adjustment of the vertical rods by relative movement of two inclined interfitting blocks which may be move relatively by threaded means on the end of the door.

Other patents generally of interests of this subject, but not showing concealed rods, are U.S. Pat. Nos. 3,819,213 issued Jun. 25, 1974 to Vanderburgh, 4,598,939 which issued Jul. 8, 1986 to Krupicka et al and 4,796,931 which issued Jan. 10, 1989 to Heid. The latter three patents are assigned to my assignee.

SUMMARY OF THE INVENTION

In the present invention the exit device is equipped with a simple rectangular slide which moves up and down as the push plate is depressed and released. Each concealed rod is attached by bracket means to a bolt which is threaded into an end of the slide. The bracket means is secured rotatably to the head of the bolt so that as the bolt is turned, the length of the rod changes. The bolt is readily accessible to the outside of the door once the cover of the latch actuator is removed. A set screw is provided in the end of the slide to hold the bolt in its selected position.

BRIEF DESCRIPTION OF THE DRAWINGS

Other features and objects of the invention will be apparent from the following specification including the drawings, all of which disclose a non-limiting form of the invention. In the drawings.

DESCRIPTION OF THE PREFERRED EMBODIMENT

Figure 1:
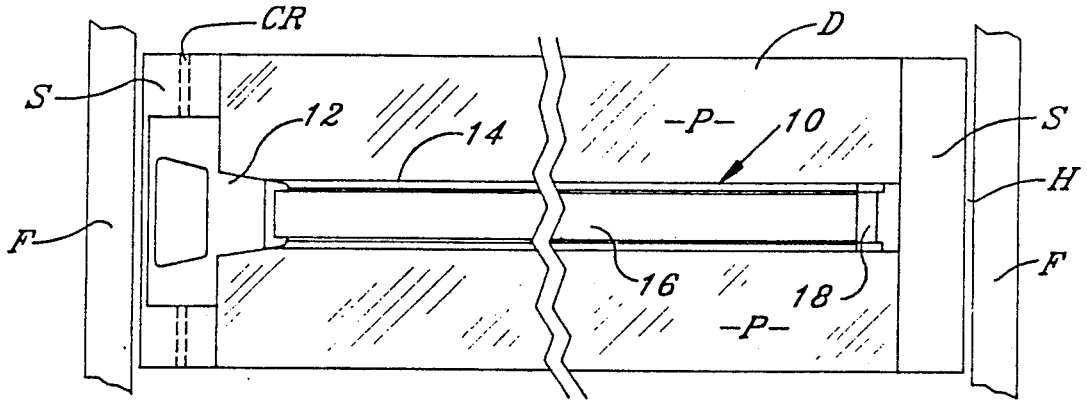
FIG. 1 is a fragmentary front elevational view of a door in its frame and having installed thereon an exit device embodying the invention.

An exit device embodying the invention is generally designated 10 in FIG. 1. It comprises a latch mechanism cover 12, horizontal channel cover 14, a push plate 16 and a frame end 18. The device is mounted on a door D having stiles S, transparent panels P and hinged means H by which the door is mounted in its frame F.

Figure 2:
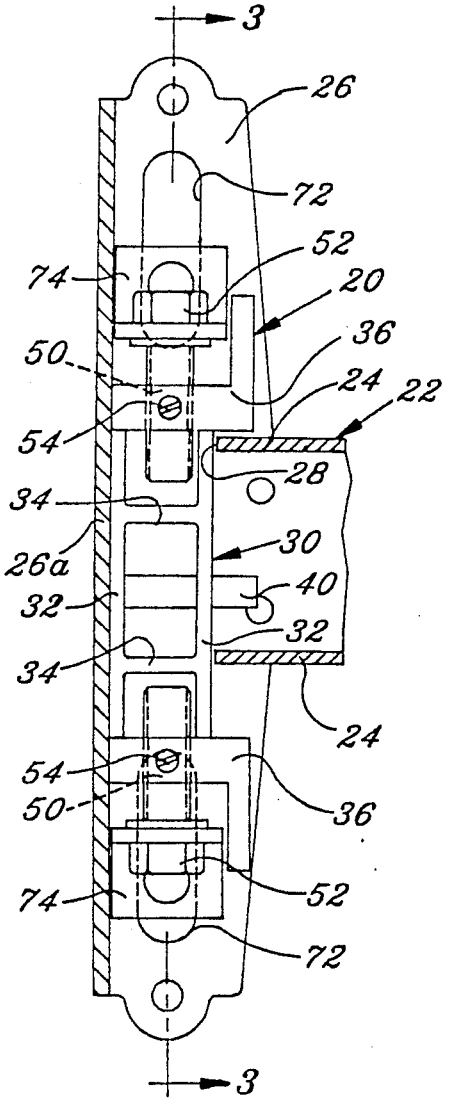
FIG. 2 is a greatly enlarged fragmentary front plan view of the latch mechanism with the latch housing removed and with the flanges of the channel 22 partly broken away for improved visability.

The housing 12 (FIG. 1) may be removed to reveal the latch actuator or mechanism generally designated 20 (FIG. 2). The mechanism is mounted in a channel 22 which underlies the horizontal channel cover 14. The channel has side flanges 24 and is riveted to a heavy metal angle 26 which forms the base of the mechanism. The flanges 22 are formed with windows 28 in which a rectangular slide 30 vertically reciprocates. The slide is provided with parallel side walls 32 having crosspieces 34 bridging thereacross and thickened L-shaped end walls 36.

Figure 5:
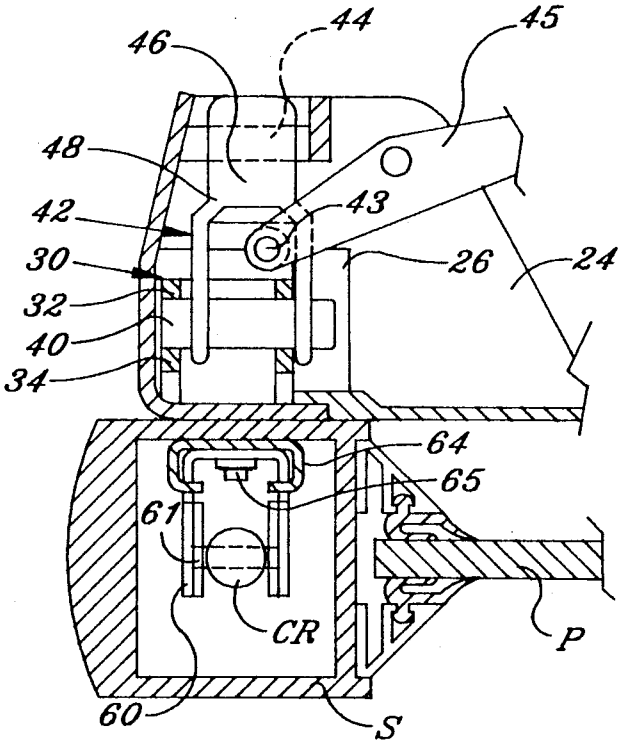
FIG. 5 is a sectional view taken on the line 5—5 of FIG. 2.

Preferably the slide including the crosspieces and end walls 36 is made from a single metal casting. An actuator pin 40 is provided and extends between the side walls 32 of the slide and outward from the inner end of the slide as shown. As is conventional, the slider is elevated by an L-shaped element 42 (FIG. 3) which is pivoted on a stationary pin 44 bridged across the top of the latch frame in a manner well known in the art. The shorter leg 46 of the element 42 is lifted readily by the crossbar 43 of the latch retractor 45 shown in FIGS. 4 and 5.

A mechanism linking the push plate to the retractor 43 is described in the aforesaid U.S. Pat. No. 4,796,932.

The longer leg 48 of the L-shaped element 42 engages under the pin 40 with the re-sult that when the push plate is pushed, the longer leg 48 pivots to raise the pin 40 and hence, the slide 30. The slide 30 is confined in place against the face 26*a* of the angle 26 (FIG. 2) by sides of the windows 28 in channel 22.

The heavy L-shaped ends 36 of the slide 30 are apertured and tapped and receive the threaded adjustment bolts 52 respectively. The bolts are screwed into the apertures 50. Intercepting the apertures 50 are tapped bores receiving set screws 54 which may be tightened by an allen wrench to assure that the bolts 52 stay in their adjusted position within the apertures 50 of the end walls 36.

Figure 3:
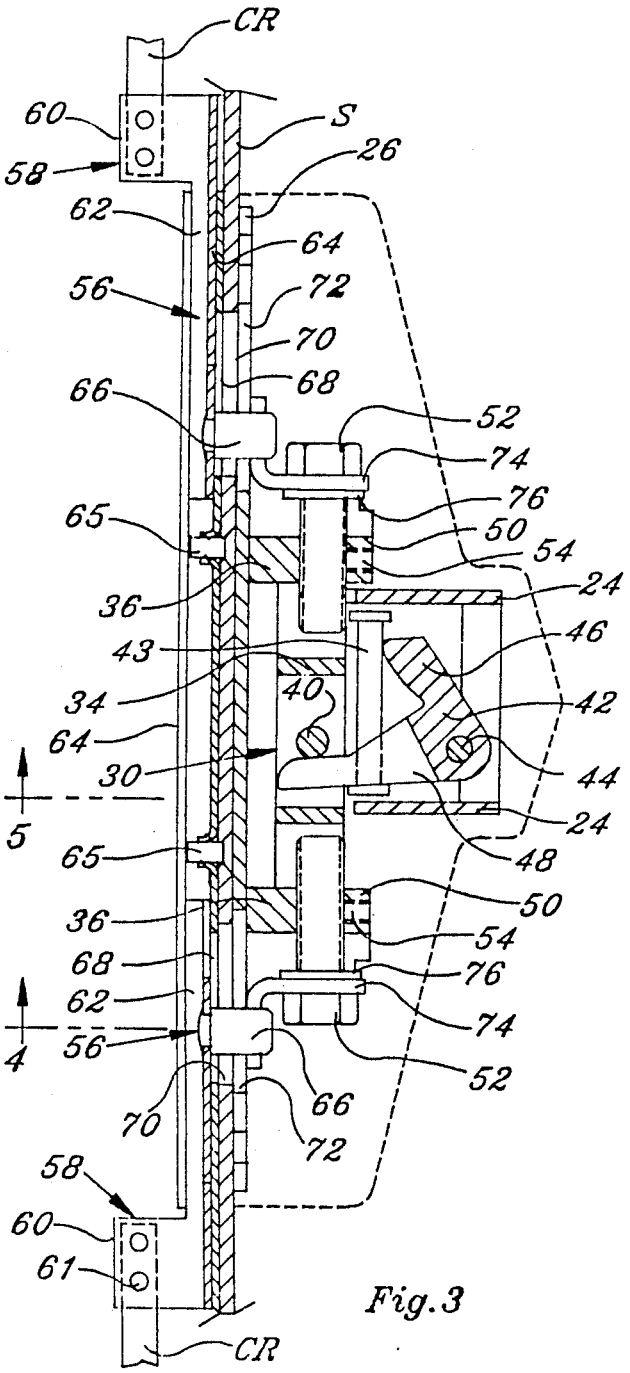
FIG. 3 is a sectional view taken on the line 3—3 of FIG. 2 with the cover shown in broken lines.
Figure 6:
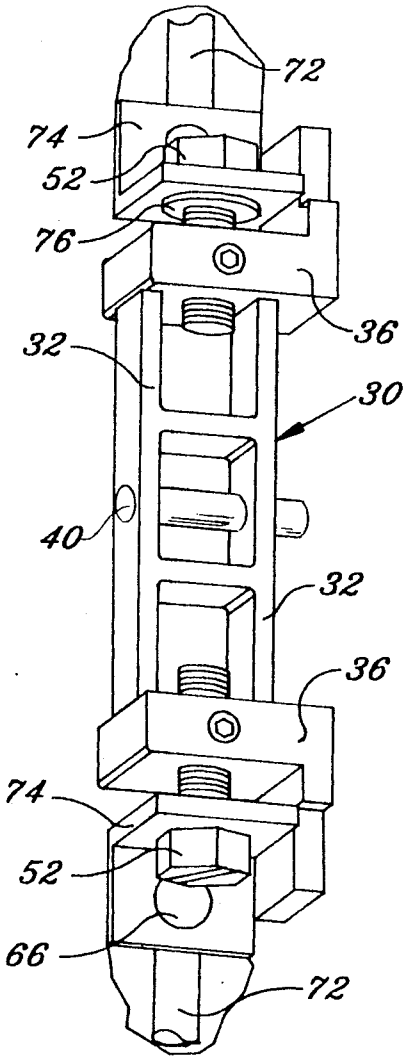
FIG. 6 is a prospective view, greatly simplified, showing the slide with attached brackets from the concealed rods and showing the ready accessibility of the adjustment bolts on the outside of the door once the latch housing is removed.
Figure 4:
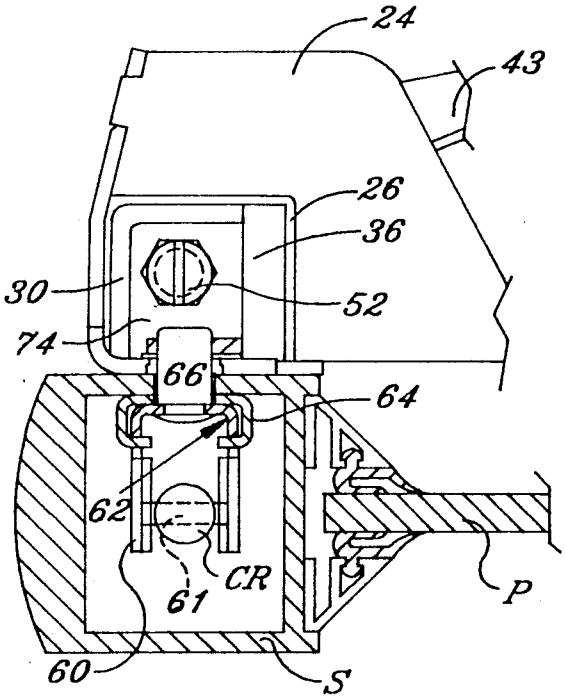
FIG. 4 is a sectional view taken on the line 4—4 of FIG. 2.

Focusing on FIG. 3, the ends of the concealed rods CR are secured to what is generally indicated as bracket means 56. The bracket means comprise three elements. First, there is the adapter 58 which comprises preferably a channel-shaped plate 60 which embraces and is secured to the end of the concealed rod CR by pins 61. From the plate extends a tail 62 which is received into a C-shaped tubular element 64 mounted on the inside of the wall of the shutting stile S by fasteners 65.

Secondly, to the inner end of the tail 62 is secured a head 66 which extends through openings 68 in the element 64, opening 70 in the stile S, and opening 72 in the angle 26 to make the outer end of the head 22 accessible to the outside of the door stile. An L-shaped clip or bracket 74, the third element of the bracket means, is secured to the outer end of the head 66. The L-shaped clip 74 has a flat horizontal leg or tab which is amply apertured to receive the shank of the bolt 52 which is rotatable therein, the head bolt butting against the leg. A retaining washer 76 is fixed axially on the bolt and shoulders against the clip 74 and immobilizes the clip with respect to axial change in relation to the head of bolt head 52.

In operation, it will be apparent that when the push plate 16 is pressed, the element 42 will be rotated clockwise by linkage well known in the art and described in U.S. Pat. No. 4,796,931 so that long leg 48 will raise the pin 40 and the rectangular slide 30 upward. The upper and lower concealed rods CR which are connected to the bolts 52 by bracket means 56 will similarly raise upward. When the push bar 16 is released, it will spring out and related linkages will permit the element 42 to rotate back to position shown in FIG. 3. This will permit the pin 40 and slide 30 to drop as will the concealed rods CR.

The adjustability of the "length" (as define above) of the concealed rods may be effected by removing cover 12 and screwing the bolts 52 inwardly or outwardly in the frame 30 as is appropriate. Before and after rotating the bolts, the set screws 54 will be loosened or tightened as is appropriate. When the concealed rods CR are of desired length, the cover 12 may be replaced when the exit device of the invention is ready for operation.

The invention has been shown herein in only a single form. It is not, however, so limited. Variations and modifications are contemplated. Hence, the invention may be regarded as having a scope as defined by the following claim language or reasonable equivalents thereof.

What is claimed is:

1. In combination, a frame, a door hinged at one side to the frame, the door hollow stiles, and a push-plate-type exit device mounted on the door over an opening in the stile the exit device comprising:

(a) a vertical latch-operating rod concealed in the stile of the door farthest from the hinge side, (b) a rectangular slider mounted for vertical reciprocation adjacent the outside of the stile alongside the push plate, one end of the slider having a vertically directed first threaded aperture therein, (c) linkage means for causing the slider to reciprocate as the push plate is pushed and released, (d) a C-shaped channel secured to the inside of the stile opposite the slider and having an opening aligned with the opening in the stile, (e) a flat tail secured to one end of the rod and sliding snugly within the C-shaped channel, (f) a perpendicular head secured to the tail and extending through the openings in the channel and the stile, (g) an L-shaped bracket comprising a vertical and a horizontal leg, the vertical leg formed with an aperture receiving the head, the horizontal leg being apertured adjacent the apertured end of the slider, (h) a rod-length-adjustment bolt extending vertically through the aperture in the horizontal leg, the bolt having retaining shoulder means holding the horizontal leg adjacent the head but permitting rotation of the bolt with respect to the horizontal leg, the bolt threadedly engaging in the first threaded opening in the slider, and (i) latch means at the other end of the rod adapted to engage cooperant means in the door frame, whereby the as. embly of the slider to the rod comprises simply securing the aperture in the vertical leg over the head and adjustment of the rod length is facilitated because the rod-length-adjustment bolt is freely accessible on the outside of the stile.

2. The combination as claimed in claim 1 further including a removable cover over the slider and linkage and when the cover is removed, the bolt is accessible for adjustment.

3. The combination as claimed in claim 1 wherein the one end of the slider is formed with a second threaded aperture intercepting the first threaded aperture and receiving a set screw for fixing the position of the bolt in the first threaded aperture.

* * * * *